US007347582B1

(12) United States Patent
Kung

(10) Patent No.: US 7,347,582 B1
(45) Date of Patent: Mar. 25, 2008

(54) INVERTIBLE LIGHT SOURCE

(75) Inventor: Kenneth Kung, Tai Tam (HK)

(73) Assignee: Dorcy International, Inc., Columbus, OH (US)

( * ) Notice: Subject to any disclaimer, the term of this patent is extended or adjusted under 35 U.S.C. 154(b) by 261 days.

(21) Appl. No.: 11/154,786

(22) Filed: Jun. 15, 2005

(51) Int. Cl.
*F21L 4/04* (2006.01)
*F21L 4/00* (2006.01)

(52) U.S. Cl. ..... 362/199; 362/396; 362/399; 362/371; 362/197; 362/177

(58) Field of Classification Search ..... 362/177, 362/199, 396, 399, 157, 371, 270, 285, 198, 362/197, 190, 191
See application file for complete search history.

(56) References Cited

U.S. PATENT DOCUMENTS

| | | | | |
|---|---|---|---|---|
| 2,156,742 | A * | 5/1939 | Shellabarger | 362/186 |
| 5,012,398 | A | 4/1991 | Jones et al. | |
| 5,469,345 | A * | 11/1995 | Pettersen et al. | 362/188 |
| 5,720,543 | A * | 2/1998 | Sheps | 362/196 |
| 5,845,037 | A | 12/1998 | Miekis | |
| 5,921,658 | A * | 7/1999 | Kovacik et al. | 362/199 |
| 6,227,677 | B1 | 5/2001 | Willis | |
| 6,296,369 | B1 * | 10/2001 | Liao | 362/186 |
| 6,328,457 | B1 | 12/2001 | Huang | |
| 6,419,377 | B1 * | 7/2002 | Yuen | 362/399 |
| 7,118,245 | B1 * | 10/2006 | Herrington | 362/185 |

FOREIGN PATENT DOCUMENTS

| | | | |
|---|---|---|---|
| EP | 00284740 | B1 | 5/1994 |
| GB | 175786 | A | 3/1922 |
| GB | 253663 | A | 6/1926 |
| GB | 386030 | A | 1/1933 |
| GB | 465599 | A | 5/1937 |
| GB | 527750 | A | 10/1940 |
| GB | 581119 | A | 10/1946 |
| GB | 603692 | A | 6/1948 |
| GB | 801432 | A | 9/1958 |
| GB | 896215 | A | 5/1962 |
| JP | 11131865 | | 5/1999 |
| WO | WO-96/25624 | A1 | 8/1996 |
| WO | WO-02/37022 | A1 | 5/2002 |

* cited by examiner

*Primary Examiner*—Jacob Y. Choi
(74) *Attorney, Agent, or Firm*—Kilpatrick Stockton LLP

(57) ABSTRACT

An invertible light source that may be configured in either an upright or an inverted configuration. The invertible light source may include a hanger that can be positioned at various locations on the housing of the light source to convert the invertible light source between the upright and inverted configurations.

19 Claims, 5 Drawing Sheets

INVERTIBLE LIGHT SOURCE

RELATED FIELDS

Embodiments of the present invention relate to portable light sources that can be positioned in both upright and inverted orientations.

BACKGROUND

Portable light sources, such as lanterns or the like, are useful for illuminating areas where other light sources are not available. Typical lanterns may include a light source (such as a light bulb), a housing or shell, at least a portion of which is translucent or semi-translucent to permit light emitted from the light source to pass, and a hanger. These lanterns may be hung using the hanger from ropes, branches, nails or other structures to position the lantern to illuminate a desired area.

With some typical lanterns, the light source is located at upper portions of the lantern such that it illuminates areas predominantly above and around the lantern. With other typical lanterns, the light source is located at lower portions of the lantern such that it illuminates areas predominantly below and around the lantern. Problematically, typical lanterns cannot be converted between a configuration that illuminates areas predominantly above and around the light source and a configuration that illuminates areas predominantly below and around the light source.

SUMMARY

Various embodiments of the present invention include invertible light sources, such as lanterns or the like, that may be converted from an upright configuration to an inverted configuration, and vice-versa. By selecting either the upright or inverted configurations, a user may choose to hang the invertible light source such that areas either predominantly above and around the light source or predominantly below and around the light source are illuminated.

Embodiments of the present invention may include a hanger moveably associated with the housing of the invertible light source, such that the hanger can be positioned on various portions of the housing to facilitate hanging the invertible light source in either an upright or inverted orientation. In some embodiments, the hanger may be associated with an upper portion of the invertible light source's housing to facilitate hanging it in an upright orientation, and may be associated with a lower portion of the housing to facilitate hanging it in an inverted orientation.

In some embodiments, the invertible light source's hanger includes a handle and a housing mating member associated with the handle. The handle may be attached to the housing mating member in a rotating fashion. The housing mating member may interact with features on the housing to alternatively position the hanger at either an upper portion of the invertible light source or at another portion below the upper portion. Changing the position of the housing mating member with respect to the housing from the upper portion to the portion below, or vice-versa, may alter the invertible light source's center of gravity to facilitate maintaining the invertible light source in either an upright or inverted orientation. Additionally, in some embodiments, the handle may be rotated, depending on the position of the housing mating member with respect to the housing, to extend either above or below the rest of the invertible light source, depending on whether an inverted or upright configuration is selected.

DETAILED DESCRIPTION OF THE DRAWINGS

FIGS. 1-5 illustrate an embodiment of an invertible light source 10 in accordance with the present invention. In the embodiment shown in FIGS. 1-5, invertible light source 10 is a lantern. However, invertible light source 10 could be any light source for use in substantially upright and substantially inverted configurations, including, but not limited to, flashlights, work lights, spotlights or other light sources. In the embodiment shown in FIGS. 1-5, lantern 10 is battery powered, however, invertible light sources in accordance with other embodiments could be used in conjunction with other power sources, including AC or DC currents supplied from power outlets, ignitable fuels, fuel cells, or any other source of energy that can be converted by the invertible light source to light energy. In the embodiment shown in FIGS. 1-5, a light bulb 12 is the light source, however, other light sources could also be used, including, but not limited to, LED lights, halogen lights, fluorescent lights, gas lights, or any multiple of the foregoing lights.

Figure 1:
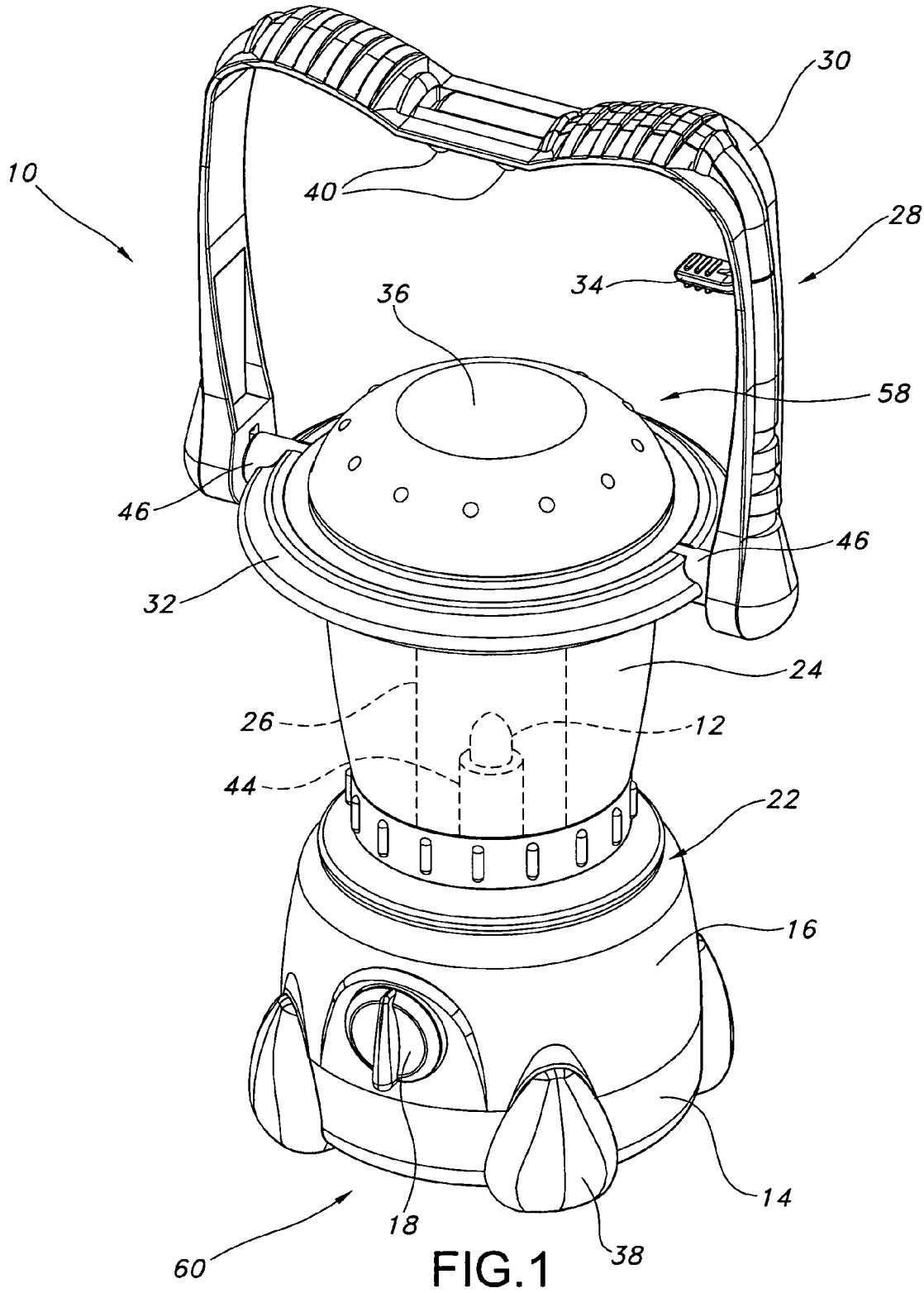
FIG. 1 shows a perspective view of an invertible light source in accordance with a first embodiment of the present invention, shown in an upright configuration.

As shown in FIG. 1, lantern 10 has a top 58 and a bottom 60, and includes a number of components, including, but not limited to: a base 14, a lower housing 16, a switch 18, first and second indentions or protrusions (20 and 22 respectively), an upper housing 24, a light bulb 12, a diffuser 26, a hanger 28 (including a handle 30, a housing mating member 32 and a hook 34), and a domed top 36. Other embodiments of the present invention may not include all of these features or may include other features not listed above.

The base 14 shown in FIG. 1, which is part of the lantern's housing, is the bottom of lantern 10 (when the lantern is in an upright orientation) and may facilitate standing lantern 10 on a relatively flat surface, such as relatively flat ground or a tabletop. In the embodiment shown in FIG. 1, four feet 38 extend from base 14 to stabilize lantern 10 when resting on a substantially flat surface, although feet 38 are not necessary in all embodiments. The base 14 of FIG. 1 is removable from lantern 10 by means of a locking mechanism (not shown), which may be any desired mechanism for securing base 14 to lantern 10. In the embodiment shown in FIG. 1, removal of base 14 allows access to, and replacement of, the batteries or other power source. In other embodiments, base 14 is not removable and/or lantern 10 is associated with its power source in another manner. In the embodiment shown in FIG. 1, base 14 is rubber and includes a textured/non-slip surface, however, base 14 can be formed from any suitable or desirable material.

The base shown in FIG. 1 is secured to the lower housing 16 of the lantern 10. As shown in FIG. 1, lower housing 16, in conjunction with base 14, may enclose the invertible light source's power source. In embodiments where the power source is one or more batteries, lower housing 16 and base 14 may include conductive elements for electrically connecting batteries to the lantern's circuitry. That circuitry may include switch 18 for turning light 12 on and off. In some embodiments, incremental rotation of switch 18 between the on and off position may brighten or dim the light 12, depending on the direction of rotation.

Additionally, the lower housing 16 shown in FIG. 1 includes the second protrusion or indention 22, although second protrusion or indention 22 could be located on other portions of lantern 10 (the first and second protrusions or indentions 20 and 22 are discussed further below). In the embodiment shown in FIG. 1, lower housing 16 is formed of opaque plastic (including either injection molded or vacuum formed plastics), although any suitable or desirable material could be used.

In the embodiment of FIG. 1, post 44, associated with and extending upwardly from lower housing 16, receives and retains the light source 12, such as a light bulb or other light source. Light bulb 12, or other light source, may be removed from the post 44 for replacement. In other embodiments, post 44 is not necessary and light source 12 may be associated with lantern 10 by other structure or in other manners.

Additionally, lower housing 16, or other structure may include features (such as threads, slots, grooves, flanges, tabs, or other suitable features) for receiving, in either a removable or non-removable manner, one or more translucent members that may protect and/or diffuse the light source. As shown in FIG. 1, the translucent members include the upper housing 24 as well as a diffuser 26. In the embodiment shown in the Figures, diffuser 26 is located inside of upper housing 24. In FIG. 1, the translucent portions of upper housing 24 are substantially clear while diffuser 26 is somewhat textured to diffuse the light from the light source 12. In other embodiments, invertible light source 10 does not include a diffuser.

Although not shown in the Figures, a reflector may be located inside and at the base of upper housing 24 to direct some of the light emitted from light source 12 in substantially upward and outward directions (when the lantern 10 is positioned in an upright orientation), inverting the lantern 10 will allow the reflector to direct some of the light emitted from light source 12 in substantially downward and outward directions. The reflector (or combinations of reflectors) may be positioned in other locations with respect to the light source 12 to alter the light dispersion of lantern 10 as desired.

In the embodiment of FIG. 1, upper housing 24 and diffuser 26 may be removed to replace light source 12, although in other embodiments upper housing 24 and/or diffuser 26 are not removable and light source 12 may or may not be replaced in other ways. Upper housing 24 and diffuser 26 may be formed from plastic, glass, or any other suitable or desirable materials.

Figure 2:
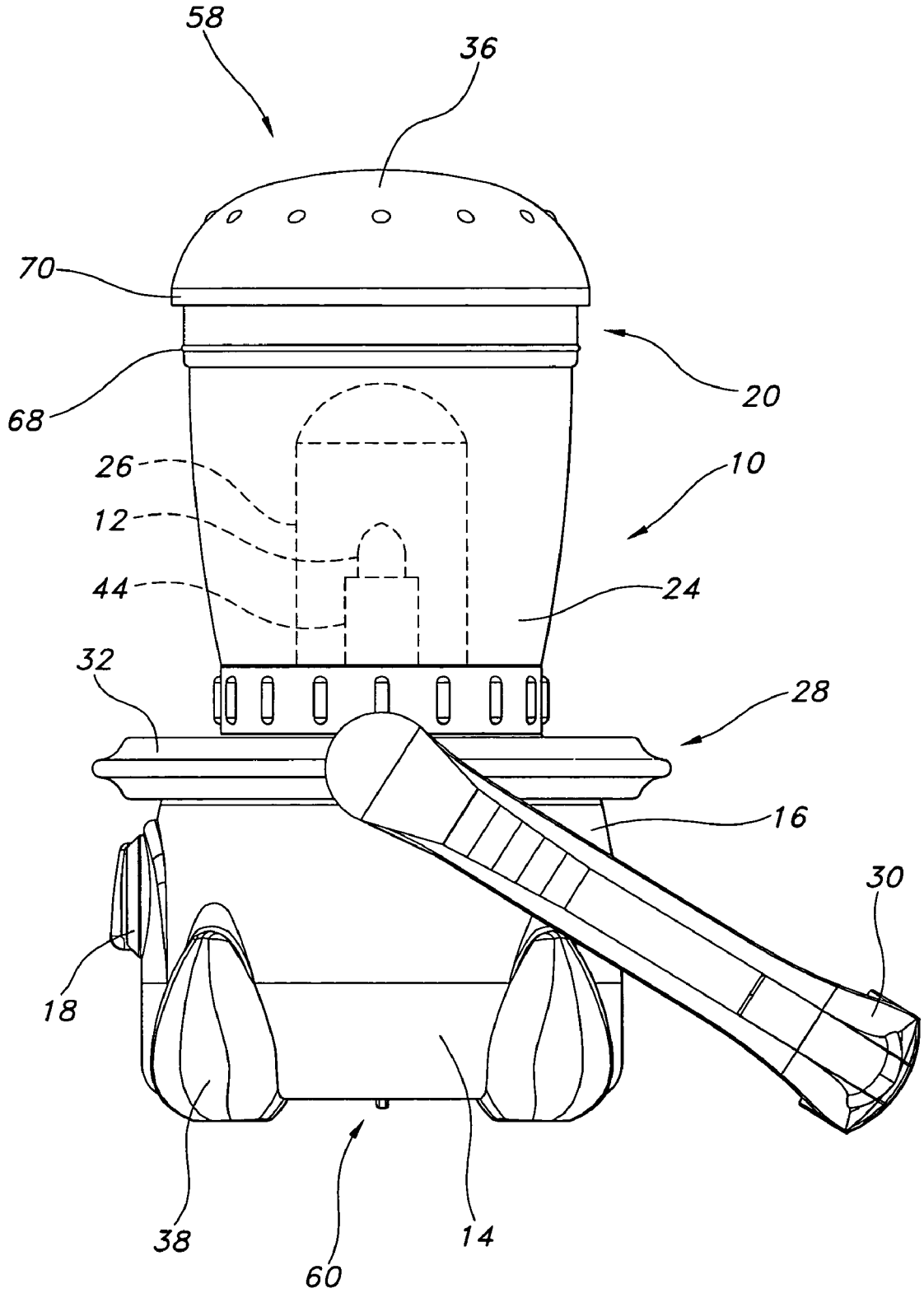
FIG. 2 shows a side view of the invertible light source of FIG. 1, not in the upright configuration of FIG. 1.

In the embodiment shown best in FIG. 2, the upper housing 24 receives domed top 36 (which is also part of the lantern's housing). The domed top 36 and upper housing 24 may include threaded portions for securing to one another, however, in other embodiments, domed top 36 and upper housing 24 may be secured together in other ways or may even be formed as a single integral piece. Similar to diffuser 26, the domed top 36 shown in the Figures is semi-translucent to diffuse light source 12, however, in other embodiments, domed top 36 may be clear or may be opaque if desired. In the embodiment of FIG. 2, domed top 36 also includes the first protrusion or indention 20, which is discussed further below. In other embodiments, the first protrusion or indention 20 is associated with other portions of lantern 10, including, but not limited to, portions of upper housing 24. Domed top 36 may be formed of plastic or any other suitable or desirable material.

Figure 3:
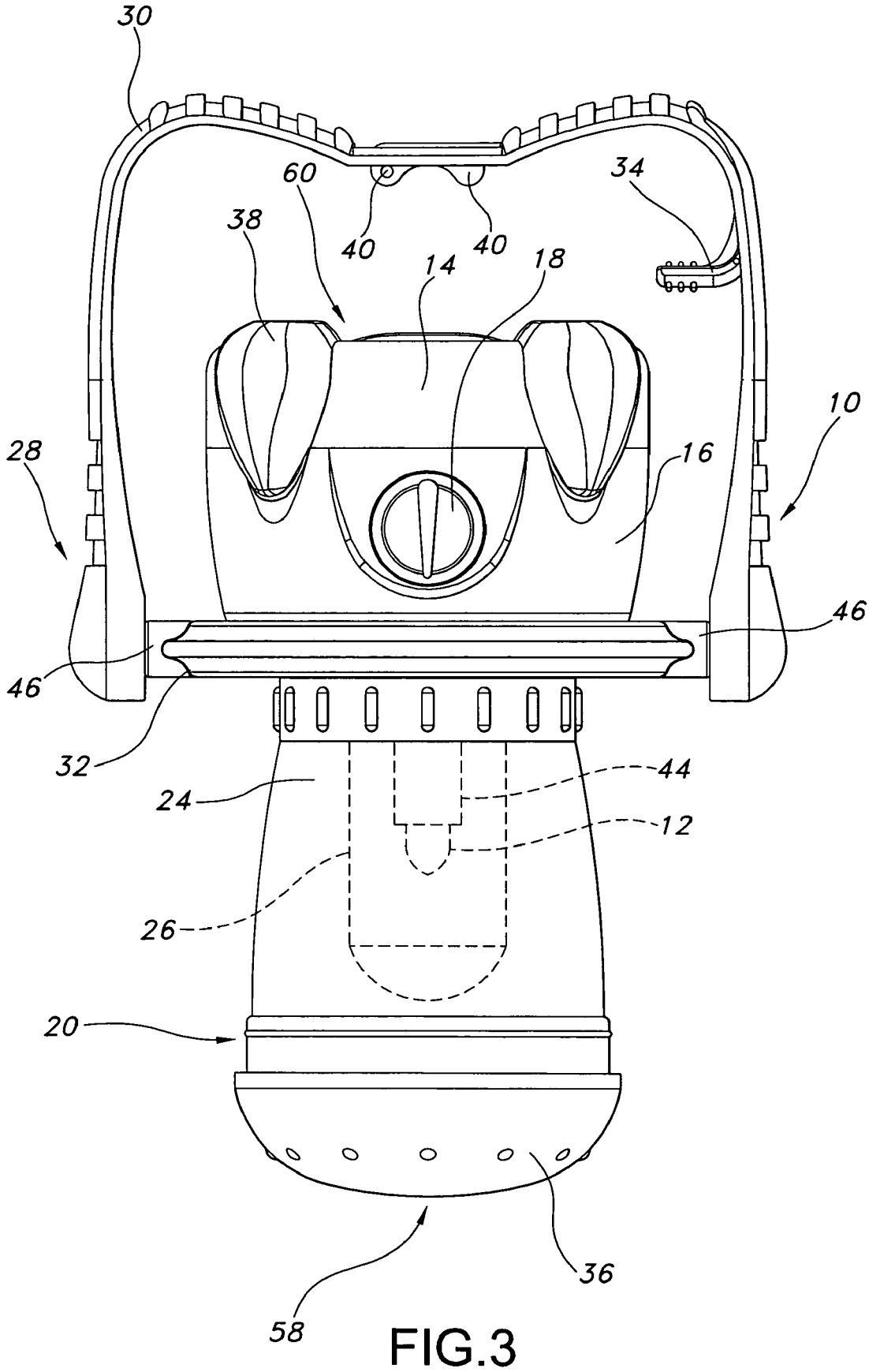
FIG. 3 shows a front view of the invertible light source of FIG. 1, shown in an inverted configuration.
Figure 4:
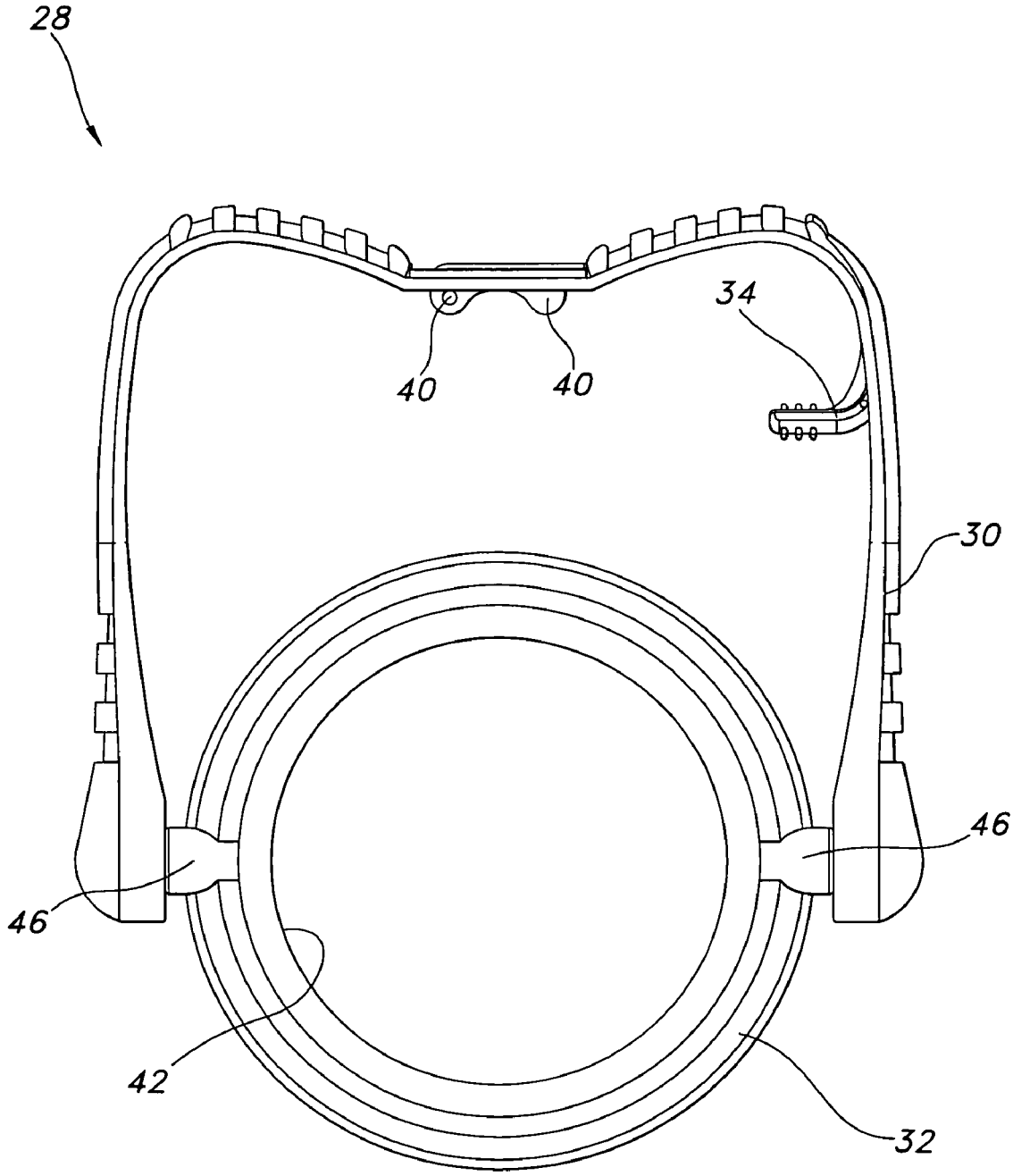
FIG. 4 shows a hanger of the invertible light source of FIG. 1, shown disassociated from the remainder of the invertible light source.

Invertible light source 10 also includes a hanger, such as the hanger 28 shown in FIGS. 1-5. As best shown in FIG. 4, the hanger 28 may include a handle 30, a housing mating member 32, and a hook 34, although in other embodiments hanger 28 may not include all these features or may include additional features.

The handle 30 and housing mating member 32 shown in FIG. 4 are associated with one another in a rotating fashion. Internal structure (not shown) may facilitate maintaining the handle 30 in certain positions with respect to the housing mating member 32 when rotated to those positions. The internal structure may include a ratcheting mechanism, a friction fit mechanism or any other type of mechanism or structure. In other embodiments, handle 30 and housing mating member 32 may include a plurality of interlocking teeth to facilitate positioning the handle 30 with respect to the housing mating member 32 in various positions.

The handle 30 shown in FIG. 4 is generally "C-shaped" and is secured in a rotating fashion to housing mating member 32 at two pivot points 46. In the embodiment of FIG. 4, the handle 30 includes a pair of ridges 40 extending from an internal surface of the handle 30. Ridges 40 may facilitate hanging the invertible light source 10 on thinner items such as a thin branch or rope such that the invertible light source 10 does not tend to slide back and forth on the branch or rope or such that the branch or rope does not slide to a corner of the handle 30, potentially causing the invertible lantern 10 to tilt.

Figure 5:
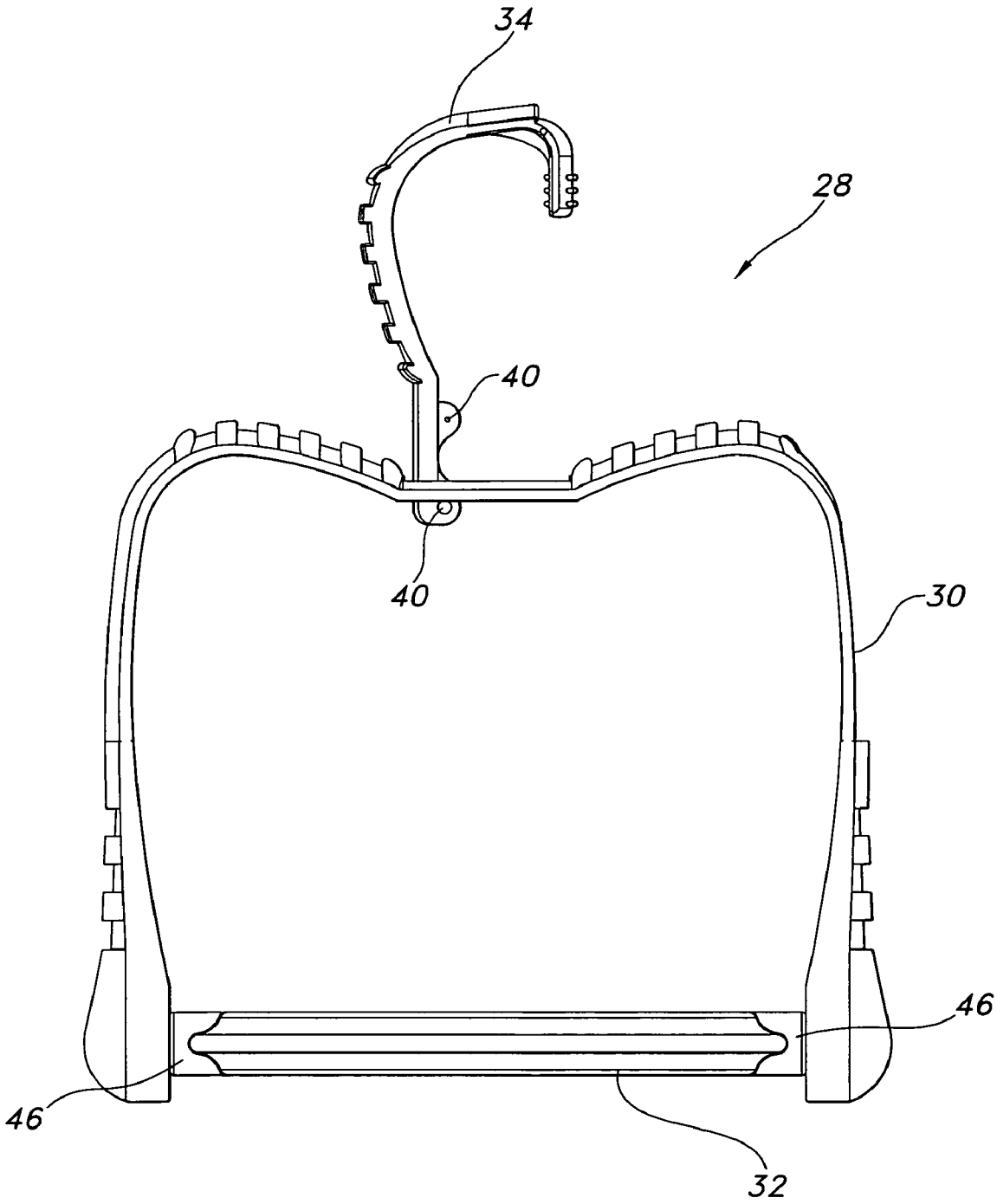
FIG. 5 shows the hanger of FIG. 4, shown with a hook extending from the hanger.

To provide other options for hanging lantern 10, the handle shown in FIG. 4 includes a hook 34 associated with the handle 30 in a rotating fashion. In the embodiment of FIG. 4, the hook may be "hidden" in the body of the handle 30 when not in use and then rotated out of the body for use (such as shown in FIG. 5). A hinge mechanism or other suitable mechanism may secure the hook 34 to the handle 30 in a rotating fashion. In other embodiments, hook 34 is not necessary. Handle 30 and hook 34 may be formed from plastic or any other suitable or desirable material.

The hanger 28 shown in FIG. 4 also includes the housing mating member 32. As discussed above, housing mating member 32 may be associated with handle 30 in a rotating fashion. In the embodiment shown in FIG. 4, housing mating member 32 is substantially ring shaped and includes an inner surface 42. Inner surface 42 may be shaped and sized to interact with first and second protrusions or indentions 20 and 22. For example, inner surface 42 may be of a width sufficient to facilitate "snapping" the housing mating member 32 into the indention 20 between protrusion 68 and the lip 70 formed by the bottom of domed top 36 (best shown in FIG. 2) to position hanger 28 at an upper portion of the invertible light source 10. In other embodiments, inner surface 42 may include an indention appropriately shaped and sized to interact with protrusions extending from the lantern housing.

Additionally, inner surface 42 may include small ridges (not shown) which facilitate engaging housing mating member 32 with the protrusions or indentions 20 and 22. For example, the small ridges may facilitate engaging housing mating member 32 with the indention 22 formed in lower housing 16. In other embodiments, other combinations and locations of ridges, protrusions and indentions may be used to facilitate associating hanger 28 with various portions of invertible light source 10.

In still other embodiments, protrusions or indentions 20 and 22 are not necessary and housing mating member may be structured, shaped and formed in other manners. For example, in one alternative embodiment, housing mating member may be a pair of prongs extending inwardly from the ends of the handle 30. In such embodiments, the prongs may engage apertures formed at various locations in the lantern's housing to allow hanger 28 to be rotatably mounted at those various locations. In other embodiments, protrusions or indentions 20 and 22 may not entirely encircle the housing, but may only extend along partial circumferences of portions of the housing.

In the embodiment shown in FIGS. 1-5, because the housing mating member 32 can interact with either first protrusion or indention 20 or second protrusion or indention 22, hanger 28 can be re-positioned to convert the lantern 10 from a substantially upright configuration to a substantially inverted configuration.

FIG. 1 shows a lantern 10 in a substantially upright configuration. In the substantially upright configuration shown in FIG. 1, housing mating member 32 is secured to first protrusion or indention 20 proximate an upper portion of lantern 10. When housing mating member 32 is positioned in this manner, at least a portion of handle 30 may be positioned to extend above the rest of the lantern 10, facilitating hanging the invertible light source 10 in a substantially upright orientation using the handle 30. In the embodiment shown in FIG. 1, the hanger 28 is positioned on the lantern 10 (at first indention or protrusion 20) such that a sufficient amount of the weight of the lantern 10 is below the housing mating member 32 such that lantern 10 may tend to maintain a substantially upright orientation when hung using handle 30. In other embodiments, first protrusion or indention 20 can be located on other portions of lantern 10 and still facilitate maintaining a substantially upright orientation when invertible light source 10 is hung using handle 30. When lantern 10 is hung in a substantially upright orientation, lantern 10 may illuminate areas predominantly above and around the lantern, although some areas below the lantern may also be illuminated.

In the embodiment shown in FIG. 2, housing mating member 32 has been disengaged from first indention or protrusion 20 (by pushing or pulling housing mating member 32 or other parts of hanger 28 downward) and has been positioned at second protrusion or indention 22.

FIG. 3 shows lantern 10 in a substantially inverted configuration. As shown in FIG. 3, during or after positioning of housing mating member 32 at second protrusion or indention 22, handle 30 may be rotated such that a portion of handle 30 extends below the bottom of the rest of lantern 10. By converting the lantern 10 to the inverted configuration, lantern 10 may be hung in a substantially inverted orientation. In the inverted configuration shown in FIG. 3, the hanger 28 is positioned on the invertible light source (at second protrusion or indention 22) such that a sufficient amount of the weight of the invertible light source 10 is below the housing mating member 32 (when the invertible light source 10 is inverted) such that lantern 10 may tend to maintain a substantially inverted orientation when hung from handle 30. In other embodiments, second protrusion or indention 22 can be located on other portions of lantern 10 and still facilitate maintaining a substantially inverted orientation when invertible light source 10 is hung from handle 30. When lantern 10 is hung is a substantially inverted orientation, lantern 10 may illuminate areas predominantly below and around the lantern, although some areas above the lantern may also be illuminated.

In still other embodiments, housing mating member 32, as well as protrusions or indentions 20 and 22 are not necessary. Rather, handle 30 may be formed in a sufficient length such that it does not need to be repositioned with respect to the housing to be rotated above and below the lantern's housing.

Additions, deletions and other modifications may be made to the embodiments described above without departing from the scope or spirit of the invention or from the claims set forth below.

The invention claimed is:

1. An invertible light source, comprising a light source associated with a housing; and a hanger associated with the housing; wherein the housing comprises a top and a bottom; wherein the hanger is positionable in at least a first and second position, the first position comprising the hanger positioned with respect to the housing such that a portion of the hanger extends above the top of the housing such that the invertible light source is in a substantially upright configuration, and the second position comprising the hanger positioned with respect to the housing such that a portion of the hanger extends below the bottom of the housing such that the invertible light source is in a substantially inverted configuration; wherein positioning the hanger in the first position comprises at least temporarily securing the hanger to an upper portion of the housing; and wherein positioning the hanger in the second position comprises at least temporarily securing the hanger to a portion below the upper portion of the housing.

2. The invertible light source of claim 1, wherein the hanger comprises a handle and a housing mating member; wherein the housing mating member at least temporarily secures the hanger to the housing.

3. The invertible light source of claim 2, wherein the handle is attached to the housing mating member in a rotating fashion.

4. The invertible light source of claim 2, wherein the housing mating member is disposed around the housing.

5. The invertible light source of claim 4, wherein the housing further comprises a plurality of protrusions or indentions for interacting with the housing mating member to at least temporarily secure the hanger to the upper portion of the housing or to the portion below the upper portion of the housing.

6. The invertible light source of claim 5, wherein the housing mating member further comprises an inner surface for interacting with the protrusions or indentions.

7. The invertible light source of claim 5, wherein the housing mating member further comprises at least one protrusion or indention disposed proximate the inner surface of the housing mating member for interacting with the housing protrusions or indentions.

8. The invertible light source of claim 5, wherein the housing protrusions or indentions comprise a first protrusion or indention positioned proximate the upper portion of the housing and a second protrusion or indention positioned closer to the lower portion of the housing than the first protrusion or indention.

9. The invertible light source of claim 2, wherein the hanger further comprises a hook associated with the handle in a rotating fashion.

10. The invertible light source of claim 9, wherein rotating the hook to a closed position locates at least a portion of the hook in an aperture extending through the handle.

11. The invertible light source of claim 2, wherein the housing further comprises a base; and wherein the base facilitates standing the invertible light source in a substantially upright orientation on a surface.

12. An invertible lantern, comprising: a light source; a lantern housing, wherein at least a portion of the housing at least partially surrounds the light source; and a hanger for hanging the lantern from a support, the hanger movably associated with the lantern housing; wherein the housing comprises a top, a bottom, an upper portion and a portion below the upper portion; and wherein the hanger is positionable with respect to the housing in at least a first and second position, the first position comprising the hanger at least temporarily secured to the upper portion of the housing and positioned such that a portion of the hanger extends above the top of the housing such that the invertible light source is in a substantially upright configuration, and the second position comprising the hanger at least temporarily secured to the portion below the upper portion of the housing and positioned such that a portion of the hanger extends below the bottom of the housing such that the invertible light source is in a substantially inverted configuration.

13. The invertible lantern of claim 12, wherein the hanger comprises a handle and a housing mating member; wherein the housing mating member at least temporarily secures the hanger to the lantern housing.

14. The invertible lantern of claim 13, wherein the handle is attached to the housing mating member in a rotating fashion.

15. The invertible lantern of claim 14, wherein the housing mating member is disposed around the lantern housing.

16. The invertible lantern of claim 14, wherein the hanger comprises a hook associated with the handle.

17. The invertible lantern of claim 16, wherein rotating the hook to a closed position locates at least a portion of the hook in an aperture extending through the handle.

18. An invertible lantern, comprising:

(a) a light source;

(b) a lantern housing; wherein at least a portion of the housing at least partially surrounds the light source; and wherein the lantern housing comprises a plurality of protrusions or indentions, a first protrusion or indention proximate an upper portion of the housing and a second protrusion or indention located below the first protrusion or indention portion;

(c) a hanger for hanging the lantern and movably associated with the housing; wherein the hanger comprises a handle and a housing mating member; wherein the housing mating member is disposed around the lantern housing and interacts alternatively with either the first or second protrusion or indention to associate the hanger with the housing; and wherein the handle is attached to the housing mating member in a rotating fashion;

wherein the invertible lantern comprises a substantially upright configuration and a substantially inverted configuration; wherein the substantially upright configuration comprises the housing mating member associated with the first protrusion or indention of the lantern housing and the handle rotated to a position such that at least a portion of the handle extends above the lantern housing; and wherein the substantially inverted configuration comprises the housing mating member associated with the second protrusion or indention of the lantern housing and the handle rotated to a position such that at least a portion of the handle extends below the lantern housing.

19. The invertible lantern of claim 18, wherein the housing mating member further comprises at least one protrusion or indention disposed proximate an inner surface of the housing mating member for interacting with the first and second protrusions or indentions.

* * * * *